US006071253A

United States Patent [19]

Rivera

[11] Patent Number: 6,071,253

[45] Date of Patent: Jun. 6, 2000

[54] SUPINE SPINAL COLUMN FLEXING FIXTURE AND METHOD

[76] Inventor: Arnold Rivera, 10201 Larson Ave., Garden Grove, Calif. 92843

[21] Appl. No.: 09/026,642

[22] Filed: Feb. 20, 1998

Related U.S. Application Data

[63] Continuation of application No. 08/562,574, Nov. 24, 1995, abandoned.

[51] Int. Cl.[7] ..... A61G 15/00

[52] U.S. Cl. ..... 601/118; 601/121

[58] Field of Search ..... 601/27, 28, 32, 601/52, 112, 115, 118–122, 128, 134, 135

[56] References Cited

U.S. PATENT DOCUMENTS 2,438,249 3/1948 Mattison .

2,582,686 1/1952 Fabio ..... 601/118

FOREIGN PATENT DOCUMENTS 87002236 4/1987 WIPO ..... 601/122

*Primary Examiner*—Danton D. DeMille

*Attorney, Agent, or Firm*—Fish & Associates, LLP

[57] ABSTRACT

There is disclosed a therapeutic exercise in which the patient lies in a supine position on a flat surface, with a long, smooth cylindrical roller having a constant compressed diameter from about 2 to about 4 inches throughout its length beneath the patient's back. The roller should be of sufficient length to span laterally across the entire patient's back and shoulders. The patient's slowly rolls his body over the roller from the sacrum along the lumbar and thoracic vertebrae by the pushing against the support surface with his feet and hands, and while shifting or rocking his body, side-to-side. The roller fixture includes a pair of end brackets which rotationally support a pair of end shafts of the roller and includes a frictional brake to restrain the rotation of the roller.

6 Claims, 3 Drawing Sheets

SUPINE SPINAL COLUMN FLEXING FIXTURE AND METHOD

This is a continuation of application Ser. No. 08/562,574 filed Nov. 24, 1995 now abandoned.

BACKGROUND OF THE INVENTION

1. Field of Invention

This invention relates to a method and apparatus for flexing of the spinal column and, in particular, to a device and method for its use in therapy and exercise.

2. Brief Statement of the Prior Art

Chronic back pain is an affliction that affects most persons during their lifetime. It is caused by many factors, principally traumatic injuries from falls or bodily contact sports, and is fostered by a sedentary lifestyle. The spinal column is formed with a plurality of articulated vertebrae which surround the spinal nerves and which separated by intervertebral disks having a central gelatinous body (nucleus pulposus) surrounded by annular layers of collagen fibris (anulus fibrosus). The nucleus cushions or absorbs shocks and weight applied to the spinal column. With injury, aging and lack of exercise, the nucleus pulposus hardens and the vertebrae lose freedom of articulation, resulting in a latent condition in which even minor activity can result in irritation and inflammation that applies pressure to the nerves, causing pain. In some injuries, the nucleus extrudes; a condition known as a herniated disk, which greatly contributes to pain and lack of articulation.

Various devices have been used as aids in articulation of the vertebrae in the spinal column. In particular, an approach advocated by many has been to roll one's back over a roller of various prescribed shapes while in a supine position. This method has the commendable goal of forced articulation of the vertebrae, however, the rollers which have been suggested for this purpose typically have an overly aggressive design which can cause discomfort, injuries or bruises that discourage continued usage. One design is to provide a roller with a central recess or groove which is placed beneath the spinal column. This design is common to the inventions of U.S. Pat. Nos. 5,170,778; 4,945,900; 4,807,603; 3,750,654; 3,616,794; and 2,221,785. Most of these patented devices also have raised circular rims on each side of the central groove and are not particularly effective as they do not place stress on the spinal column, but rather apply uncomfortable, and potentially bruising forces to one's back tissue and muscles. Another device proposes an opposite construction; using three integral balls; one central, large diameter ball with a small ball at each side. The size of the central ball, and the lack of lateral support by the smaller diameter balls renders this device overly aggressive and its use by inexperienced patients can result in injury or accentuate back pain. Another device which is also overly aggressive is shown in U.S. Pat. No. 2,577,129 in which a roller is moved along a large arcuate path beneath the lumbar vertebrae.

Although a constant diameter padded roller is disclosed in U.S. Pat. No. 3,419,268, that roller is not used as an aid to articulate vertebrae along the spinal column, but instead is used as a cushioning support for the sacrum while performing other exercises.

Another patent (U.S. Pat. No. 4,832,006) suggests the use of rollers which support treatment wheels of varied diameters which are designed in function of their thickness, profile, diameter and number to massage the critical muscles, tendon, ligaments and articulations in a specific body region. U.S. Pat. No. 2,577,129 discloses the use of a roller with and without protrusions which is rock up and down by the user who pulls on handles of the frame, causing the user's body to lift upwardly, minimizing the degree of flexing of the spinal column.

A common failing of all these devices is the aggressiveness of treatment, either by failure to provide support across one's entire back, which unavoidably concentrates forces at localized areas with consequential discomfort and the potential of injury.

OBJECTIVES OF THE INVENTION

It is an objective of this invention to provide a method for safe therapeutic use by a patient suffering from spinal column dysfunctions.

It is also an objective of this invention to provide a device which permits the patient to control the degree of articulation of the vertebrae during exercise, thereby permitting the patient to become accustomed to the treatment, reducing the chance for injury.

It is also an objective of this invention to provide a device and method for exercising and strengthening of the back muscles.

It is an additional objective of this invention to provide a device and method for increasing separation of the spinal vertebrae.

It is likewise an objective of this invention to provide a device and method to reduce the build up of calcium deposits surrounding the vertebrae.

It is a further objective of this invention to provide a device and method which can soften the nucleus pulposus and anulus fibrosus.

It is an additional objective of this invention to provide a device and method which will enhance blood flow to spinal column areas, thereby increasing the delivery of oxygen, nutrition and enzymes to those areas.

It is yet another objective of this invention to provide a device and method that will relieve back pain and discomfort.

It is a further objective of this invention to provide a device which is simple to use and a method which requires only a few minutes of activity each day.

Other and related objectives will be apparent from the description of the preferred embodiments of the invention.

Brief Statement of the Invention

The method of the invention is practiced with the patient lying in a supine position on a flat supporting surface, e.g., the floor, by placing a long, smooth cylindrical roller having a constant compressed diameter from about 2 to about 4 inches throughout its length beneath the patient's back. The roller is rotationally supported by a pair of end brackets which provide minimal elevation of the roller above the floor. The roller is of sufficient length to span entirely across the patient's back and shoulders so that the patient's shoulder and back muscles are moved across the roller. The patient slowly rolls his or her body over the roller from the sacrum to the upper shoulders by pushing with his or her feet and hands against the supporting surface. During this movement, or while pausing at any desired location along the spinal column, particularly when pain is experienced, the patent shifts, side-to-side, to cause lateral rocking and shifting of his or her body on the roller.

The roller fixture which is preferably used in the method includes a pair of end brackets which rotationally receive end shafts of the roller and support the roller above the floor.

Preferably, a frictional brake is mounted in each end bracket to restrain rotation of the roller.

BRIEF DESCRIPTION OF THE DRAWINGS

The invention will be described with reference to the drawings of which.

DESCRIPTION OF PREFERRED EMBODIMENT

Figure 1:
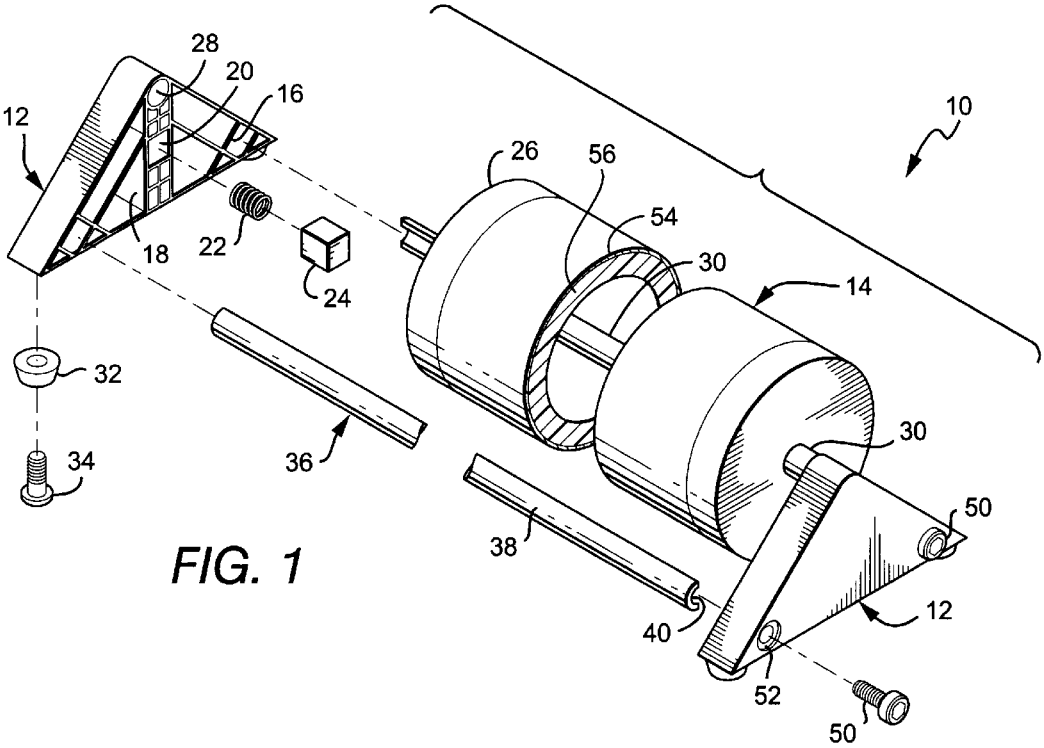
FIG. 1 is an exploded perspective view of the roller fixture of the invention.
Figure 2:
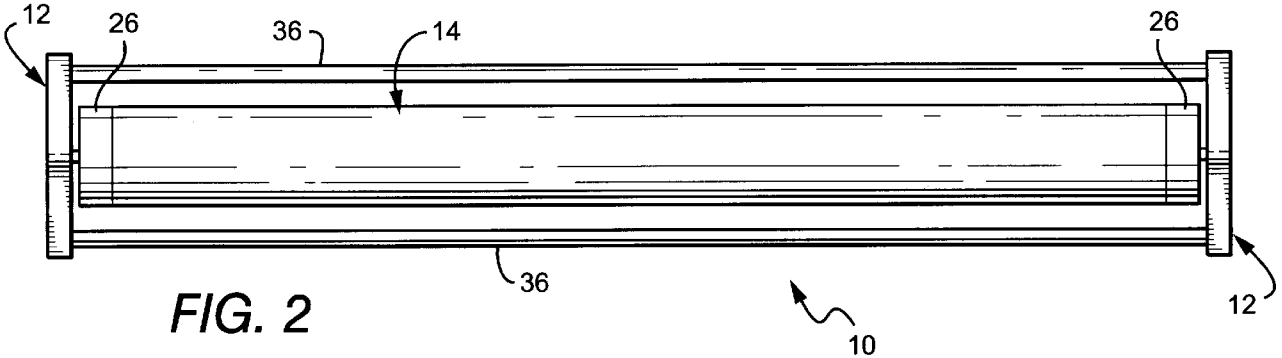
FIGS. 2 and 3 are top and front views of the roller fixture of the invention and FIG. 4 is an enlarged view of the end of the roller fixture.
Figure 3:
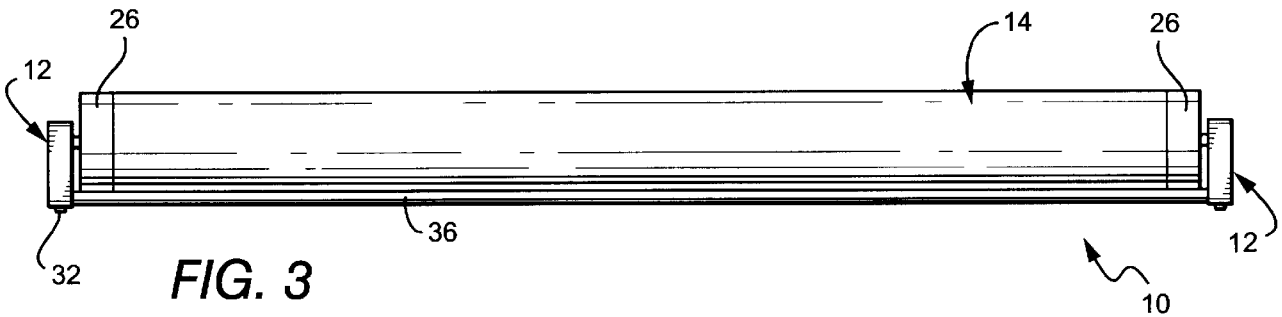
Figure 4:
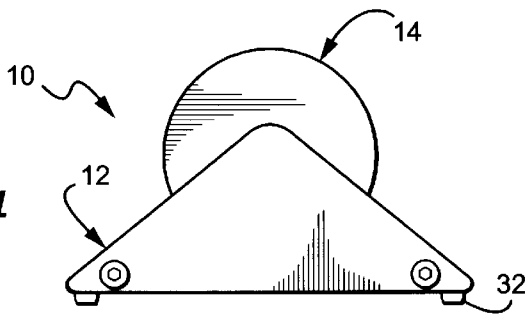

FIG. 1 is an exploded perspective view of the roller fixture 10 of the invention which, preferably, is used to practice the treatment of the invention. FIGS. 2–4 are top, front and end views of the assembled roller fixture 10. As there illustrated, the fixture 10 comprises a pair of end brackets 12 at each end of a long cylindrical roller 14, which is formed of a plastic cylinder with permanently attached end caps which support the roller shaft. In the illustrated embodiment, the brackets 12 are triangular end plates molded of a suitably strong plastic. Each bracket 12 is hollowform with internal webbing or bracing 16 and has an internal post 18 which has a recess 20 that receives a compression spring 22 and a plastic block 24 which serves as a friction brake as it is pressed against the end cap 26 of the roller 14 by the resilient bias of the spring 22.

At its upper end, the post 18 has a cylindrical recess 28 to receive the end of the roller shaft 30, thereby providing rotational support for the roller 14. Preferably the undersurface of each bracket receives a pair of distally located feet such as the rubber grommets 32 which are secured with a conventional screw fastener 34.

The brackets are assembled with a pair of extruded rods 36 with an outer convex arcuate surface 38 and a central channel 40 which receives screw fasteners 50 that extend through apertures 52 at opposite lower corners of each bracket 12.

The brackets 12 support the roller 14 at a minimal elevation above the support surface, providing sufficient elevation for the roller 14 to clear the support surface.

Preferably, the roller 14 is formed of a cylindrical plastic pipe. The pipe is preferably covered with a thin (0.25–0.75 inch) layer 54 of compressible plastic or rubber foam or is covered with a protective covering of a sheet of plastic, e.g., polyethylene, polyvinylchloride, etc. Preferably the protective covering is smooth and non-porous, so that it does provide a significant frictional resistance to the lateral movement of the patient's body. The foam layer beneath the protective covering provides sufficient padding to avoid any bruising of the patient's muscles or tissue. The preferred has a maximum compression of about 50 percent, so approximately 50 percent of its thickness contributes to the overall compressed diameter of the roller 14.

Figure 5:
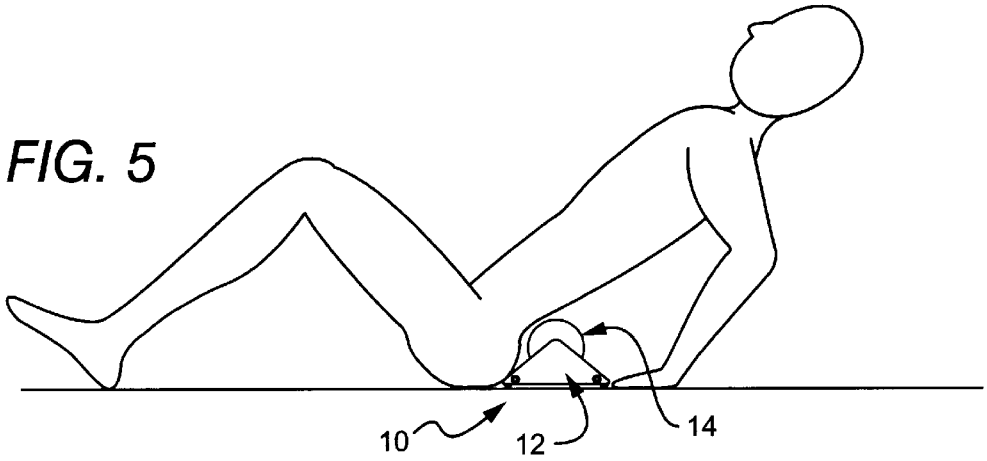
FIG. 5 illustrates a patient starting to practice the method of the invention with the roller placed beneath the lumbar vertebrae of the spinal column.

FIG. 5 illustrates the patient about to start the treatment of the invention. The patient sits on the floor or other supporting surface, and places the roller fixture 10 of the invention, with cylindrical roller 14 rotationally supported by end brackets 12 beneath his back. The roller 14 is of sufficient length to span completely across the patient's shoulders and back, approximately 24–36 inches in length and of a diameter from 2.5 to about 4 inches. The length of the roller 14 is sufficient to insure that the patient's weight is supported by the patient's back and shoulder muscles, i.e., the trapezius, deltoid, rhomboideus major, teres minor, teres major and latissimus dorsi muscles. The roller 14 is also of limited diameter and its axis of rotation above the supporting surface is limited so that the roller 14 will flex the patient's spinal column without overly aggressive treatment caused by the application of excessive weight or force to a localized region of the spinal cord. The patient then lowers his body to rest the roller 14 against the internal and external oblique muscles and underlying tissue and muscle, causing the lumbar vertebrae to flex.

Figure 6:
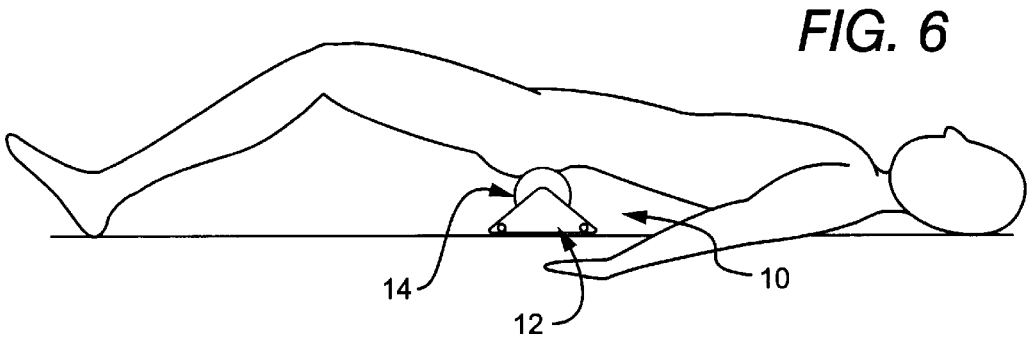
FIG. 6 illustrates the patient practicing the method with the roller beneath the sacrum for flexing of the muscles of the lower back and lower lumbar vertebrae.

FIG. 6 illustrates the patient's sacrum above the roller 14, resting on the gluteus maximus and medius muscles. Patient's experiencing lower back and leg pain can pause at this location and gently rock or shift their bodies side-to-side to obtain a complete pelvic treatment. As the patient rolls downwardly and upwardly with the roller 14 from this position while rocking or shifting his weight side-to-side, the pelvic, sacrum and lower lumbar vertebrae are caused to articulate, flexing under the applied patient's weight. The patient controls movement across the roller 14 by pushing against the floor with his hands and feet and the frictional restrain of the roller by the brakes 24 is sufficient to prevent the patient's body from coasting downwardly during the movement from the position shown in FIG. 6 to that shown in FIG. 7, thereby permitting the patient to control movement along the roller.

Figure 7:
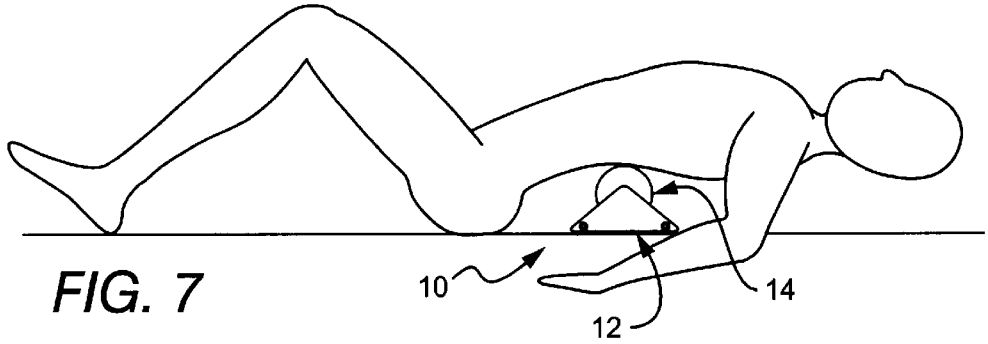
FIG. 7 illustrates the patient practicing the treatment of the invention by moving along the roller to cause movement of the patient's lumbar vertebrae across the roller.

FIG. 7 illustrates the patient reaching another position, having pushed his body to move from the position shown in FIG. 6, with the roller 14 moving along the oblique and seratus posterior inferior muscles and underlying tissue and muscles, causing movement of the rib cage and articulation and flexure of the lumbar vertebrae. The intensity and effectiveness of the articulation and flexing is controlled by the patient, by the amount of his weight released against the roller 14 and by the degree of lateral or side-to-side shifting or rocking.

Figure 8:
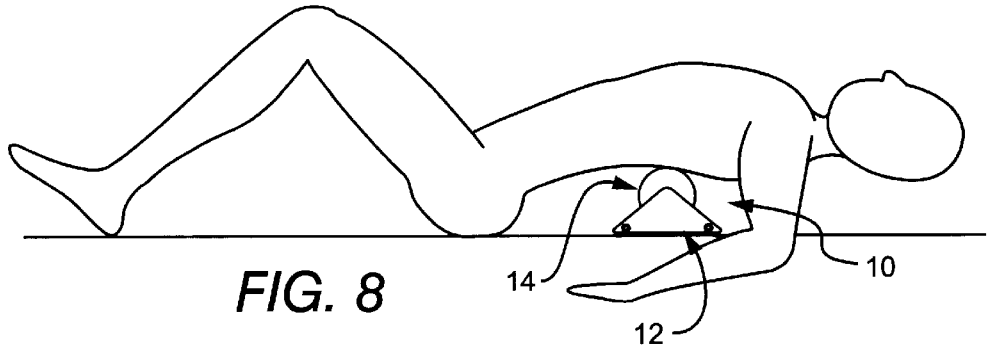
FIG. 8 illustrates the patient practicing the treatment of the invention by moving along the roller to cause movement of the patient's thoracic vertebrae across the roller.

FIG. 8 illustrates the patient reaching a position with the roller 14 beneath the thoracic vertebrae, having pushed his body to move from the position shown in FIG. 7, with the roller 14 moving along the latissimus dorsi and underlying tissue and muscles such as the erector spinae, to move the rib cage and cause the thoracic vertebrae to articulate and flex. As the patient continues the movement along the roller 14 the patient's weight is supported on the deltoid, trapezius, teres minor and major, and infraspinatus muscles, all causing movement of the rib cage with consequential articulation and flexing of the thoracic vertebrae.

Figure 9:
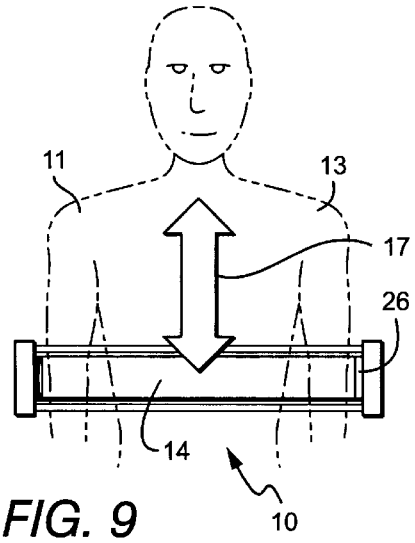
FIG. 9 illustrates the position of a patient on the roller fixture of the invention moving from the position shown in FIG. 7 to that shown in FIG. 8.

FIG. 9 is a top view of the patient on the roller fixture 10, in the general location shown in FIG. 7. As shown in this view, the patient rests, supine, on the roller 14, with the opposite ends of the roller 14 extending laterally beyond the patient's back and shoulders 11 and 13, thereby insuring that the patient's weight is evenly supported across the patient's entire back, rather than at any localized area. As previously mentioned, the patient moves his body across the roller 10 in the general direction indicated by arrowhead line 17, moving to the position shown in FIG. 8. During this movement, the patient may also rock or slide his body, side-to-side, on the roller 14 so that the vertebrae of the spinal column are articulated laterally (side-to-side) as well as medially, arching over the roller 14 above the supporting surface.

Figure 10:
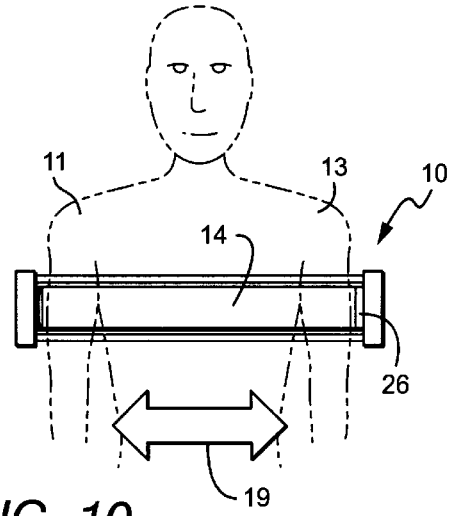
FIG. 10 illustrates the patient shifting or rocking laterally on the roller in the position shown in FIG. 8.

When the patient reaches a position on the roller where pain or discomfort is experienced, the patient pauses at that location for a short duration, e.g., from 10 to about 30 seconds and gently shifts his body side-to-side to encourage lateral flexing of the spinal column. This is illustrated in FIG. 10, as though the patient experienced pain or discomfort at the location shown in FIG. 8. As illustrated, the patient shifts his body, side-to-side, at this location as depicted by the arrowhead line 19.

The device was used by persons having common complaints of back discomfort and pain. The device was initially used in the manner shown in FIGS. 5–8, with only medial movement along the spinal column, along the arrowhead line 17 shown in FIG. 9. Many of the persons, particularly those with serious problems such as ruptured vertebrae, did not experience any significant relief from the treatment method. Those persons were then instructed to include in their practice of the method, a gentle side-to-side shifting as they moved their bodies lengthwise along the roller, and to pause their advance over the roller for 10 to 20 seconds at the location of greatest pain, while continuing to shift their bodies side-to-side on the roller. After completion of the treatment in this manner, all persons reported a dramatic decrease in pain and discomfort.

The roller 14 which is used in the method is a smooth surfaced roller 14 of a constant diameter throughout its entire length so that the patient's body is adequately supported across the patient's entire back, avoiding any sharp edges or grooves which could bruise or damage the spinal column or the surrounding muscles and tissue and which would resist or prevent the patient's movement, side-to-side on the roller. For most patients, the diameter of the roller 14 in its compressed condition, under the weight of the patient, should be from 2.5 to 4 inches. The maximum diameter is selected to insure adequate flexing of the spinal column, while the minimum diameter is selected to avoid excessive articulation which can result from rollers of lesser diameter.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A spine-flexing fixture comprising:

a roller having a pair of end shafts which are rotationally received by a pair of end brackets at opposite ends of said roller, each end bracket having a base which rests on a support surface and a recess which receives a respective one of said end shafts and which is located above said base a distance which supports an undersurface of said roller above the support surface a distance no greater than 0.5 inch;

said roller having an external padding with a smooth cylindrical surface free of grooves, recess or protuberances and having a length at least equal to the distance across one's shoulders and a compressed diameter between 2 and 4 inches which is constant along its length; and a frictional brake supported by at least one of said end brackets and resiliently biased to a sliding, frictional engagement with an end of said roller.

2. The spine-flexing fixture of claim 1, wherein the frictional brake is supported on each of said end brackets and is bearing against each of the ends of said roller to provide rotational restrain of said roller.

3. The spine-flexing fixture of claim 1, wherein said base plate has a length extending substantially along the length of one's body.

4. The spine-flexing fixture of claim 1 including a smooth, non-porous, low-friction covering on said roller.

5. A method for flexing the spinal cord of a patient which comprises:

placing the spine-flexing fixture of claim 1 on a flat support surface;

having the patient lie in a supine position with one's hips, back and head resting on said surface with said spine-flexing fixture beneath one's back, and spanning entirely laterally across one's back and shoulders;

moving one's body over the roller along one's lumbar and thoracic vertebrae and shifting one's body side-to-side on the roller while permitting the roller to apply an upward force laterally distributed against one's back muscles and tissue to cause the vertebrae above said roller to flex medially and laterally.

6. The method of claim 5, wherein said rolling is accomplished by flexing one's knees and pushing with one's feet against said flat surface.

* * * * *